US006541190B1

(12) United States Patent
Haye et al.

(10) Patent No.: US 6,541,190 B1
(45) Date of Patent: Apr. 1, 2003

(54) ODORLESS PHOTOGRAPHIC FIXING COMPOSITION AND METHOD OF USE

(75) Inventors: Shirleyanne E. Haye, Rochester, NY (US); Janet M. Huston, Webster, NY (US); Therese M. Feller, Rochester, NY (US); Eric R. Schmittou, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/012,773

(22) Filed: Oct. 30, 2001

(51) Int. Cl.[7] ..... G03C 5/38; G03E 7/42
(52) U.S. Cl. ..... 430/455
(58) Field of Search ..... 430/455

(56) References Cited

U.S. PATENT DOCUMENTS

| | | | | | |
|---|---|---|---|---|---|
| H1063 | H | * | 6/1992 | Hosoi | 430/264 |
| 5,183,727 | A | | 2/1993 | Schmittou et al. | 430/372 |
| 5,258,275 | A | * | 11/1993 | Arai et al. | 430/523 |
| 5,352,563 | A | * | 10/1994 | Kawasaki et al. | 430/264 |
| 5,582,966 | A | * | 12/1996 | Nakamura et al. | 430/569 |
| 5,633,124 | A | | 5/1997 | Schmittou et al. | 430/372 |
| 5,766,830 | A | * | 6/1998 | Shimizu et al. | 430/398 |
| 6,013,424 | A | | 1/2000 | Schmittou et al. | 430/455 |

OTHER PUBLICATIONS

Research Disclosure 187028 Nov. 1979.*
USSN 10/012,673, (D–80818) "Processing Photographic Material" by P.J. Twist, filed on even date herewith.
USSN 10/012,611, (D–83561) "Odorless Photographic Bleach–Fixing Composition and Method Of Use" by S.E. Haye et al, filed on even date herewith.

* cited by examiner

*Primary Examiner*—Hoa Van Le
(74) *Attorney, Agent, or Firm*—J. Lanny Tucker

(57) ABSTRACT

A photographic fixing composition has reduced odor and improved storage stability. It comprises a thiosulfate fixing agent, sulfite ions, and a phthalic acid or salt thereof. This fixing composition can be used in various photographic processing protocols to provide color images from color photographic silver halide materials.

22 Claims, No Drawings

ODORLESS PHOTOGRAPHIC FIXING COMPOSITION AND METHOD OF USE

FIELD OF THE INVENTION

This invention relates in general to photography. More particularly, it relates to a photographic fixing composition, and to a method of processing color photographic silver halide elements using that composition.

BACKGROUND OF THE INVENTION

The basic image-forming process of color silver halide photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver ion is generally removed by dissolving it in a silver solvent, commonly known as a fixing agent.

In some photochemical processes, bleaching and fixing are combined in a bleach-fixing step using a composition that includes both a bleaching agent to oxidize metallic silver and a fixing agent to dissolve the remaining silver ion.

A wide variety of fixing agents and silver solvents are known, as described for example in U.S. Pat. No. 5,633,124 (Schmittou et al.) and publications noted therein. Thiosulfate salts are generally preferred as fixing agents because they are inexpensive, highly water soluble, non-toxic, non-odorous, and stable over a wide pH range. Thus, fixing is usually accomplished using a thiosulfate fixing agent that diffuses into the element, and forms silver thiosulfate complex that diffuses out of the element. In large photofinishing labs, the elements are usually immersed in a fixing solution for from 4 to 6 minutes. In small minilabs, the fixing time is shorter, that is from 90 to 120 seconds.

Fixing compositions are generally buffered to a pH of from about 4 to about 8 to achieve maximum silver "fixing" using common buffering agents such as acetic acid, succinic acid, or malic acid. They also usually include sulfite ions to serve as a silver halide solvent, to help control pH, and to act as a preservative. While such fixing compositions are effective for their intended purpose, they may have objectionable odor and keeping problems as decomposition reactions can form sulfur.

Thus, there is a need for a highly effective photographic fixing composition that has reduced odor and improved keeping stability.

SUMMARY OF THE INVENTION

This invention provides a photographic fixing composition that has a pH of from about 4 to about 12 when in aqueous form, and comprises:

at least 0.05 mol/l of a thiosulfate fixing agent, at least 0.01 mol/l of sulfite ions, and at least 0.025 mol/l of a phthalic acid or a salt thereof.

This invention also provides a method for providing a color photographic image comprising contacting a color developed color photographic silver halide material with the photographic fixing composition described above.

In another embodiment, a method for providing a color photographic image comprises:

A) color developing an imagewise exposed color photographic silver halide material in a predetermined volume of an aqueous color developing composition in a processing chamber, and B) without removing the predetermined volume of the aqueous color developing composition or the color photographic silver halide material from the processing chamber, adding a predetermined volume of the photographic fixing composition described above to the processing chamber to provide a combined aqueous color development/fixing composition, and fixing the color photographic silver halide material.

Further embodiments include an additional step of:

C) without removing the combined aqueous color development/fixing composition or the color photographic silver halide material from the processing chamber, adding a predetermined volume of a photographic bleaching composition to the processing chamber to provide a combined aqueous color development/fixing/bleaching composition, and bleaching the color photographic silver halide material.

The photographic fixing composition of this invention has been shown to have improved keeping stability and reduced odor without diminishing its photographic processing properties. These advantages are achieved by using a phthalic acid or a salt thereof in the fixing composition.

DETAILED DESCRIPTION OF THE INVENTION

The photographic fixing compositions of this invention generally have a pH of from about 4 to about 12 when in aqueous form. Preferably, the pH is from about 4 to about 8, and more preferably, it is from about 4.5 to about 7.

The photographic fixing composition can be packaged and transported as a dry or liquid formulation, working strength solution, or as a single-part concentrated composition. It can be used as a replenisher as well as the initial tank working solution. Preferably, the photographic fixing composition is provided in aqueous form.

It should be understood that the photographic fixing compositions of this invention are intended for rapid and efficient removal of silver(I) from color photographic elements, either before, during or after bleaching, or any combination of these. Preferably, however, the fixing compositions have fixing activity only (no purposely added bleaching agents), and the only bleaching agents that may be present in the fixing composition are those carried over from a preceding bleaching solution by the photographic element being processed.

The first essential component in the photographic fixing composition comprises one or more thiosulfate fixing agents. The thiosulfate can be any of sodium thiosulfate, potassium thiosulfate, ammonium thiosulfate, lithium thiosulfate, calcium thiosulfate, or magnesium thiosulfate, or mixtures thereof such that a desired concentration of thiosulfate ion is provided. Preferably, ammonium thiosulfate or sodium thiosulfate (or a mixture thereof) is used. For rapid fixing, ammonium thiosulfate is preferably used.

Optionally, one or more thiocyanate fixing agents can also be present as a fixing agent especially for more rapid silver removal. If present, it can be provided as sodium thiocyanate, potassium thiocyanate or ammonium thiocyanate, or mixtures thereof. Preferably ammonium or sodium thiocyanate (or mixtures thereof) is used. The thiosulfates and thiocyanates can be obtained from a number of commercial sources or prepared using conventional starting materials and synthetic procedures.

A second essential component of the photographic fixing composition is a source (or mixture of sources) of sulfite ions. Useful salts that provide sulfite ions include but are not limited to sodium sulfite, potassium sulfite, ammonium sulfite, sodium bisulfite, sodium metabisulfite, potassium metabisulfite, and mixtures of such salts such that the desired sulfite concentration is obtained.

The third essential component of the photographic fixing composition is a phthalic acid or a salt thereof. By "a phthalic acid", we mean to include substituted phthalic acids. Preferred salts of phthalic acid include hydrogen phthalates such as sodium hydrogen phtbalate, potassium hydrogen phthalate, ammonium hydrogen phthalate, lithium hydrogen phthalate, sodium phthalate, and potassium phthalate. Potassium hydrogen phthalate and sodium hydrogen phthalate are preferred. Mixtures of two or more of these compounds can also be used.

The concentrations (general and preferred) of the three essential components of the photographic fixing composition of this invention are listed in TABLE I below wherein all of the ranges of concentrations are considered to be approximate (that is "about").

TABLE I

| COMPONENT | GENERAL AMOUNT (mol/l) | PREFERRED AMOUNT (mol/l) |
|---|---|---|
| Thiosulfate fixing agent | 0.05 to 5 | 0.1 to 4 |
| Sulfite ions | 0.01 to 1 | 0.03 to 0.5 |
| Phthalic acid or salt thereof | 0.025 to 1 | 0.025 to 0.75 |

If a thiocyanate fixing agent is also present in the photographic fixing composition, it is generally present in an amount of from about 0.05 to about 5 mo/l.

Optional addenda that can be present in the photographic fixing composition if desired are materials that do not materially affect its photographic fixing function. Such materials include, but are not limited to, biocides, alkyl or arylsulfinic acids or their salts, halides (such as bromide ions, chloride ions, or iodide ions), photographic hardeners, conventional buffering agents (such as acetic acid or succinic acid), metal ion sequestering agents (such as polycarboxylic acids, polyaminopolycarboxylic acids, and polyphosphonic acids), fixing accelerators, and other materials readily apparent to one skilled in the photographic art. These and other optional materials can be present in conventional amounts [for example as described in U.S. Pat. No. 5,633,124 (noted above].

The essential and optional components of the photographic fixing compositions of this invention can be mixed together in any suitable order as would be known in the art, and stored for a time or used immediately as liquid or solid formulations. They can be formulated in aqueous concentrates such that dilution up to 10 times is required before or during use. Alternatively, they can be formulated as solid compositions (tablets, pellets, powders or granules) and added to a processing tank with appropriate amounts of water for use.

During photographic processing, conventional procedures can be used for replenishment of the various processing solutions, including the photographic fixing solution. Preferably, the rate of fixing solution replenishment is not more than 3000 ml/m$^2$, and preferably from about 250 to about 1500 ml/m$^2$ of processed photographic material. The processing equipment can be any suitable processor having one or more processing tanks or vessels, including minilab processors and larger scale processors. The fixing step can be carried out in one or more tanks or stages arranged in concurrent or countercurrent flow.

The present invention can be used advantageously with any of the known methods of applying photographic fixing compositions to photographic materials. These methods include, but are not limited to, immersing the material into an aqueous fixing composition (with or without agitation or circulation), bringing the material into contact with a web or drum surface that is wet with the fixing composition, laminating the material with a cover sheet or web in such a way that the fixing composition is brought into contact with the material, or applying the fixing composition to the material by high velocity jet or spray.

The fixing step can be generally carried out at a temperature of from about 20 to about 65° C. (preferably from about 30 to about 60° C.). The time of processing during this fixing step is generally up to 360 seconds and preferably at least 10 and up to 240 seconds (more preferably from about 10 to about 120 seconds).

The other processing steps needed to provide color images can be similarly rapid or conventional in time and conditions. Preferably the other processing steps, such as color development, bleaching, and/or stabilizing (or rinsing), are likewise shorter than conventional times. For example, color development can be carried out for from about 12 to about 360 seconds, bleaching for from about 12 seconds to about 8 minutes, and stabilizing (or rinsing) for from about 15 to about 240 seconds in various processing protocols. The fixing step can be carried out more than once in some processing methods. The processing methods can have any of a wide number of arrangements of steps, as described for example in U.S. Pat. No. 5,633,124 (noted above) that is incorporated herein by reference.

In rapid processing methods, the total processing time for color negative films, can be up to 360 seconds (preferably from about 60 to about 250 seconds), and the total processing time for color papers can be up to 100 seconds (preferably from about 40 to about 100 seconds).

The present invention can therefore be used to process silver halide materials of various types including color papers (for example using Process RA-4), color motion picture films and prints (for example using Process ECP, Process ECN and Process VNF-1), and color negative films (for example using Process C-41) or color reversal films (for example using Process E-6). The various processing sequences, conditions and solutions for these processing methods are well known in the art.

Preferably, the photographic fixing composition of this invention is used in a novel rapid processing protocol that is identified herein as a "merged solution" processing method. This method generally includes, in order, color development and fixing, and optionally bleaching.

For example, a color photographic image can be provided (especially in color negative films) by the following steps:

A) color developing an imagewise exposed color photographic silver halide material in a predetermined volume of an aqueous color developing composition in a processing chamber, and B) without removing the predetermined volume of the aqueous color developing composition or the color photographic silver halide material from the processing chamber, adding a predetermined volume of the photographic fixing composition of this invention to processing chamber to provide a combined aqueous color development/fixing composition, and fixing the color photographic silver halide material.

Preferably, the "merged solution" processing method further includes the step of:

C) without removing the combined aqueous color development/fixing composition or the color photographic silver halide material from the processing chamber, adding a predetermined volume of a photographic bleaching composition to the processing chamber to provide a combined aqueous color development/fixing composition to provide a combined aqueous color development/fixing/bleaching composition, and bleaching the color photographic silver halide material.

Alternatively, after step B, the color photographic silver halide material or combined color development/fixing composition can be removed from the processing chamber and further processed with one or more separate processing compositions, such as a photographic bleaching composition, in the same or different processing chamber.

There can be additional processing steps between steps A and B (such as use of a washing or "stop" solution), or between steps B and C (such as use of a washing solution), or after step C (such as use of a washing, rinsing, or stabilizing solution). It may be particularly useful to include an acidic "stop" solution between steps A and B. Solutions added between steps A and B, or between B and C, will necessarily be included in the final solutions that can be discarded or regenerated in any suitable manner. Alternatively, solutions added after step C can also be included in the final solutions of the method. In other words, steps carried out after step C can be conventional processing steps or additional "merged solution" processing steps.

The volumes of the various processing compositions used in the methods of this invention will vary depending upon the type of color photographic material being processed and the particular processing protocol used (for example, from large tank volumes to "minilab" volumes).

When the "merged solution" process is used, for example, to process color negative film, the predetermined volume of color developing composition introduced into the processing chamber is generally from about 50 to 2850 ml/m$^2$ and preferably from about 140 to about 1170 ml/m$^2$, of surface area of processed color photographic silver halide material. The predetermined volume of fixing composition introduced into the processing chamber may be sufficient to provide an additional volume of from about 6 to about 2000 ml/m$^2$ and preferably from about 20 to about 800 ml/m$^2$, per surface area of processed color photographic silver halide material Intermediate (for example washes, or "stop" solutions) or additional processing compositions (such as a bleaching composition) may be introduced into the processing chamber to each provide an additional volume of from about 6 to about 2000 ml/m$^2$ and preferably from about 20 to about 800 ml/m$^2$, of surface area of processed color photographic silver halide material.

For processing color papers using the "merged solution" processing method, the predetermined volumes of color developing composition introduced into the processing chamber may be generally from about 30 to about 400 ml/m$^2$ and preferably from about 40 to about 150 ml/m$^2$ The fixing composition can be then introduced into the processing chamber sufficient to provide an additional volume of from about 1 to about 220 ml/m$^2$ and preferably from about 10 to about 100 ml/m$^2$.

Thus, the volumes of processing solutions can be large like those used in the more conventional Process C-41 processing methods, or small like those generally used in "minilabs" or "SM" processors.

The one or more processing steps in this "merged solution" processing method can be carried out at the same or different temperatures generally within the range of from about 20 to about 65° C., and preferably at from about 30 to about 60° C.

In the "merged solution" processing method, step A is generally carried out for at least 15 seconds, and preferably for at least 25 seconds, and up to 195 seconds for color negative films and color papers, and up to 360 seconds for color reversal films.

If a "stop" solution is used between steps A and B, this intermediate step is generally carried out for at least 5 seconds, preferably 10 seconds, and up to 60 seconds.

Step B is then carried out for at least 5 seconds, and preferably for at least 10 seconds, and up to 120 seconds for color negative films, up to 90 seconds for color papers, and up to 300 seconds for color reversal films.

After at least 5 seconds of fixing in Step B, the photographic bleaching composition can be added to the combine aqueous color development/fixing composition. Fixing will continue for a time simultaneously with bleaching. Step C can then be carried out for at least 10 seconds, and preferably for at least 25 seconds, and up to 240 seconds for color negative films and color papers and up to 360 seconds for color reversal films.

In the "merged solution" processing method, the essential steps are carried out in the same processing chamber that can be of suitable size and shape to accommodate the processed materials and the various volumes of processing compositions that are added together throughout the various processing steps. The larger the volume of fluids added and the more steps used, the larger the processing chamber will likely be. In preferred embodiments, the volumes of each processing composition is small so that the total volume of the combined solutions at the end of the processing method is easily discarded. In such instances, the processing method can be considered a "single-use" processing method.

One suitable processing apparatus that can be used to carry out the "merged solution" processing method is described in more detail in copending and commonly assigned U.S. Ser. No. 09/920,495 (filed Aug. 1, 2001 by Twist et al.).

Thus, in one embodiment of the "merged solution" processing method of this invention, a suitable processing chamber is loaded with an imagewise exposed color photographic material to be processed, and a metered (predetermined) amount of color developing composition is introduced into the chamber. Color development is then allowed to proceed for a suitable time. Without removing the color photographic material or color developing composition from the processing chamber, a metered (predetermined) amount of the fixing composition of this invention in then introduced into the processing chamber to provide a combined color developing/fixing composition. Fixing is then carried out for a suitable time. An intermediate "stop" solution can be introduced prior to addition of the fixing composition.

Without removing the color photographic material or the combined color developing/fixing composition, a metered (predetermined) amount of a bleaching composition is added to the processing chamber to provide a combined color developing/fixing/bleaching composition. Bleaching is then carried out for a suitable time. Additional processing steps (such as washing, rinsing, or stabilizing) can be carried out if desired in the same or different processing chamber and with or without removal of the combined color developing/fixing/bleaching composition.

In each of these processing steps, each solution is spread uniformly over the entire surface of the color photographic material to provide uniform processing. Each processing step is preferably carried out in a high agitation, batch processor that is used to process one color photographic material at a time with small volumes.

Further details of these processing embodiments are provided in copending and commonly assigned U.S. Ser. No. 10/012,673 filed on even date herewith by Twist and entitled "Processing Photographic Material".

The emulsions and other components, and structure of color photographic materials used in this invention and the various procedures for manufacturing them are well known and described in considerable publications, including, for example, *Research Disclosure*, publication 38957, pages 592–639 (September 1996), and *Research Disclosure*, Volume 370, February 1995, and hundreds of references noted therein. Research Disclosure is a publication of Kenneth Mason Publications Ltd., Dudley House, 12 North Street, Emsworth, Hampshire PO10 7DQ England (also available from Emsworth Design Inc., New York, N.Y. 10011). This reference will be referred to hereinafter as "Research Disclosure". More details about such materials are provided herein below. In particular, the invention can be practiced with photographic films containing any of many varied types of silver halide crystal morphology, sensitizers, color couplers, and addenda known in the art, as described in the noted Research Disclosure publication and the many publications noted therein. The films can have one or more layers, at least one of which is a silver halide emulsion layer that is sensitive to electromagnetic radiation, disposed on a suitable film support (typically a polymeric material).

The processed color negative films may have a magnetic recording layer, or stripe, on the support opposite the silver halide emulsion layer(s). Formulations for preparing magnetic recording layers are also well known in the art, as described for example, in Research Disclosure, publication 34390, November, 1992, U.S. Pat. No. 5,395,743 (Brick et al.), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding, or laminating.

Various supports can be used for such color negative films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane4,4'-dicarboxylate and poly (butylene terephthalate) are preferred. These materials can be subbed or unsubbed and coated with various antihalation, antistatic, or other non-imaging layers as is known in the art. Particularly useful antistatic layers on the backside of the materials include vanadium pentoxide in a suitable binder.

Representative photographic materials that can be processed to advantage using the present invention include, but are not limited to, KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

Reagents for color development compositions are well known, and described, for example, in Research Disclosure (noted above), sections XVIII and XIX, and the many references described therein. Thus, besides a color developing agent (such as a p-aminophenol or p-phenylenediamine), the color developers can include one or more buffers, antioxidants (or preservatives, such as sulfo-,carboxy, and hydroxy-substituted mono- and dialkylhydroxylamines), antifoggants, fragrances, solubilizing agents, brighteners, halides, sequestering agents, and other conventional addenda. Representative teaching about color developing compositions can also be found in U.S. Pat. No. 4,170,478 (Case et al.), U.S. Pat. No. 4,264,716 (Vincent et al.), U.S. Pat. No. 4,482,626 (Twist et al.), U.S. Pat. No. 4,892,804 (Vincent et al.), U.S. Pat. No. 5,491,050 (Brust et al.), U.S. Pat. No. 5,709,982 (Marrese et al.), U.S. Pat. No. 6,037,111 (Haye et al.), U.S. Pat. No. 6,017,687 (Darmon et al.), U.S. Pat. No. 6,077,651 (Darmon et al.), U.S. Ser. No. 09/706,463 (filed Nov. 3, 2000 by Haye et al.), and U.S. Ser. No. 09/706,474 (filed Nov. 3, 2000 by Arcus et al.), all incorporated herein by reference.

A preferred photographic color developing composition has a pH of from about 9.5 to about 13 and comprises 4-(N-ethyl-N-β-hydroxyethylamino)-2-methylaniline sulfate (KODAK CD-4 Color Developing Agent), bromide ions, sulfite ions, and a carbonate buffer.

Photographic bleaching compositions are also well known, as described for example, in Research Disclosure (noted above), section XX and the many references noted therein. Common bleaching agents for such compositions include, but are not limited to, ferric salts or ferric binary or ternary complexes of aminopolycarboxylic acids of many various structures including but not limited to ethylenediaminetetraacetic acid, 1,3-propylenediaminetetraacetic acid, iminodiacetic acid, methyliminodiacetic acid, ethylenediaminedisuccinic acid (either the S,S isomer alone or a racemic mixture of isomers), ethylenediamine monosuccinic acid, and others as described for example in U.S. Pat. No. 5,334,491 (Foster et al.), U.S. Pat. No. 5,582,958 (Buchanan et al.), U.S. Pat. No. 5,585,226 (Strickland et al.), U.S. Pat. No. 5,652,085 (Wilson et al.), U.S. Pat. No. 5,670,305 (Gordon et al.), and U.S. Pat. No. 5,693,456 (Foster et al.), all incorporated herein by reference.

A particularly useful photographic bleaching composition has a pH of from about 3 to about 8 and comprises 1,3-propylenediaminetetraacetic acid (or salt thereof), ferric nitrate, and succinic acid.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al.), U.S. Pat. No. 5,441,852 (Hagiwara et al.), U.S. Pat. No. 5,529,890 (McGuckin et al.), U.S. Pat. No. 5,534,396 (McGuckin et al.), U.S. Pat. No. 5,578,432 (McGuckin et al.), U.S. Pat. No. 5,645,980 (McGuckin et al.), and U.S. Pat. No. 5,716,765 (McGuckin et al.), all incorporated herein by reference.

The photographic fixing composition of this invention can be provided in any suitable container, and can also be included in a processing kit with one or more other processing compositions in suitable containers.

The following examples are provided to illustrate the practice of the present invention and are not meant to be limiting in any way.

EXAMPLES 1 and 2

Stabilized Photographic Fixing Compositions

Two photographic fixing compositions of this invention were formulated and evaluated for storage stability for six weeks. The initial formulations are shown in TABLE II below. The aqueous compositions were stored in open glass containers at room temperature. Any decrease in volume from evaporation was compensated for by periodically adding deionized water. The compositions were also analyzed periodically (after 1, 3, and 6 weeks) for the amounts of remaining thiosulfate, sulfite ion, and the change in pH. The results are shown in TABLE III below. They indicate that the fixing compositions of this invention had storage stability. In addition, both fixing compositions were odorless.

TABLE II

| COMPONENT | EXAMPLE 1 (mol/l) | EXAMPLE 2 (mol/l) |
|---|---|---|
| Ammonium thiosulfate | 2.68 | 2.68 |
| Ammonium sulfite | 0.24 | 0.24 |
| Sodium metabisulfite | 0.041 | 0.041 |
| Potassium hydrogen phthalate | 0.17 | 0.1 |
| pH | 5.40 | 5.75 |

TABLE III

| TIME (weeks) | Thiosulfate(%) Example 1 | Thiosulfate(%) Example 2 | Sulfite(%) Example I | Sulfite(%) Example 2 | pH Example 1 | pH Example 2 |
|---|---|---|---|---|---|---|
| 0 | 100 | 100 | 100 | 100 | 5.40 | 5.75 |
| 1 | 100 | 100 | 94.8 | 89.2 | 5.44 | 5.79 |
| 3 | 100 | 100 | 90.5 | 94.0 | 5.41 | 5.71 |
| 6 | 98.3 | 98.8 | 85.3 | 87.1 | 5.39 | 5.67 |

EXAMPLES 3

Comparisons of Photographic Fixing Compositions

The photographic fixing composition of Example 2 was compared to two conventional fixing compositions containing acetic acid or succinic acid as the buffering agent. The two comparative fixing compositions (Controls A and B) are shown in TABLE IV below. The three fixing compositions were monitored in replicate while being aerated at a flow rate of 325 ml/min. at room temperature in an opened glass container. The compositions were also monitored periodically (2, 8, and 22 days) for the amounts of remaining thiosulfate and sulfite ions. The results are shown in TABLE V below. They show that the use of the phthalate improves composition stability over the control compositions. The change in pH was minimal for all three compositions. Precipitates were observed in the Control A and B compositions after 15–20 days. The Control B composition was odorless but the Control A composition had a noticeable odor.

TABLE IV

| COMPONENT | CONTROL A (mol/l) | CONTROL B (mol/l) |
|---|---|---|
| Ammonium thiosulfate | 2.68 | 2.68 |
| Ammonium sulfite | 0.24 | 0.24 |
| Sodium metabisulfite | 0.041 | 0.041 |
| Acetic acid | 0.1 | 0 |
| Succinic acid | 0 | 0.1 |
| pH | 5.40 | 5.75 |

TABLE V

| TIME (days) | Thiosulfate(%) Example 2 | Thiosulfate(%) Control A | Thiosulfate(%) Control B | Sulfite(%) Example 2 | Sulfite(%) Control A | Sulfite(%) Control B |
|---|---|---|---|---|---|---|
| 0 | 100 | 100 | 100 | 100 | 100 | 100 |
| 2 | 99 | 100 | 98.7 | 98.7 | 93.1 | 93.2 |
| 8 | 100 | 100 | 100 | 85.1 | 76.8 | 72.9 |
| 22 | 97 | 97.8 | 97 | 23.4 | 17.5 | 13.8 |

EXAMPLES 4

Photographic Processing Using "Merged Solution" Method

Samples of conventional KODAK Max Zoom Color Negative Film were imagewise exposed to a 21-step chart and processed using the following processing compositions and conditions. This example illustrates the use of combined color developing/fixing and color developing/fixing/bleaching compositions in the "merged solution" processing method described above.

The imagewise exposed color negative film samples were placed in a cylindrical processing canister, and 250 ml of Color Developing Composition A (identified below) was added at 49° C. After 60 seconds of color development, 167 ml of the fixing composition described in Example 2 above (shown in TABLE II) was added all at once to the processing canister with rapid mixing at 49° C. After 10 seconds, 175 ml of the Bleaching Composition A (identified below) was added all at once to the processing canister with rapid mixing for 120 seconds at 49° C.

The processed film samples were then washed for 120 seconds with water and dried to provide the desired color images.

| | |
|---|---|
| Color Developing Composition A: | |
| Sodium sulfite | 6.0 g/l |
| Sodium bromide | 2.1 g/l |
| Sodium Carbonate, monohydrate | 31.5 g/l |
| 4-amino-3-methyl-N-ethyl-(2-hydroxyethyl)aniline sulfate | 6.75 g/l |
| pH (adjust with sulfuric acid or sodium hydroxide) | 10.0 |
| Bleaching Composition A: | |
| 1,3-Diaminopropanetetraacetic acid | 156.8 g/l |
| Succinic acid | 50.0 g/l |
| Ferric nitrate, 9 hydrate | 188 g/l |

Ammonium hydroxide and water to give a volume of 1 liter and pH of 3.5

EXAMPLES 5

Fixing in Process C-41 Processing Method

Samples of KODAK Gold 100 Color Negative Film were imagewise exposed using a step wedge test object exposure at 1/25 sec with DL Va filter and 3000K-color temperature lamp on a 1B sensitometer. The resulting exposed samples were processed using the standard Process C-41 conditions and commercially available KODAK FLEXICOLOR processing compositions except for the fixing composition that was as described below.

| Fixing Composition: | |
|---|---|
| $Na_2SO_3$ | 0.111 mol/l |
| Ammonium thiosulfate | 0.57 mol/l |
| Ammonium sulfite | 0.052 mol/l |
| Potassium hydrogen phthalate | 0.087 mol/l |
| $NH_4SCN$ | 1.278 mol/l |
| EDTA $Na_2$ | 0.003 mol/l |
| AgBr | 0.100 mol/l |
| $NH_4I$ | 0.005 mol/l |
| Water to make 1 liter. | |
| pH 6.5 | |

The sensitometric results in all three color records from conventional sensitometric curves that were obtained by processing the film samples in this manner are provided in the following TABLE VI.

TABLE VI

| | Red | Green | Blue |
|---|---|---|---|
| $D_{max}$ | 1.796 | 2.314 | 2.836 |
| Mid | 0.864 | 1.304 | 1.685 |
| Toe | 0.292 | 0.701 | 1.032 |
| $D_{min}$ | 0.242 | 0.649 | 0.949 |

These results indicate that acceptable color images were obtained using this processing method of the invention.

The invention has been described in detail with particular reference to certain preferred embodiments thereof, but it will be understood that variations and modifications can be effected within the spirit and scope of the invention.

We claim:

1. A photographic fixing composition that has a pH of from about 4 to about 12 when in aqueous form, and comprising:

at least 0.05 mol/l of a thiosulfate fixing agent, at least 0.01 mol/l of sulfite ions, and at least 0.025 mol/l of a phthalic acid or a salt thereof.

2. The fixing composition of claim 1 that is in aqueous form and has a pH of from about 4 to about 8.

3. The fixing composition of claim 1 comprising phthalic acid, sodium hydrogen phthalate, potassium hydrogen phthalate, ammonium hydrogen phthalate, lithium hydrogen phthalate, sodium phthalate, and potassium phthalate sodium hydrogen phthalate, potassium hydrogen phthalate, or mixtures of two or more of these compounds.

4. The fixing composition of claim 3 comprising sodium hydrogen phthalate or potassium hydrogen phthalate.

5. The fixing composition of claim 1 wherein said thiosulfate fixing agent is present in an amount of from about 0.05 to about 5 mol/l, and said sulfite ions are present in an amount of from about 0.01 to about 1 mol/l.

6. The fixing composition of claim 1 wherein said phthalic acid or a salt thereof is present in an amount of from about 0.025 to about 1 mol/l.

7. The fixing composition of claim 1 wherein said thiosulfate fixing agent is present in an amount of from about 0.1 to about 4 mol/l, said sulfite ions are present in an amount of from about 0.03 to about 0.5 mol/l, and said phthalic acid or a salt thereof is present in an amount of from about 0.025 to about 0.75 mol/l.

8. The fixing composition of claim 1 further comprising succinic acid.

9. An aqueous fixing composition having a pH of from about 4.5 to about 7 and comprising:

from about 0.1 to about 4 mol/l of ammonium thiosulfate fixing agent, from about 0.03 to about 0.5 mol/l of sulfite ions, and from about 0.025 to about 0.75 mol/l of sodium hydrogen phthalate, potassium hydrogen phthalate, or a mixture thereof.

10. A method for providing a color photographic image comprising contacting a color developed color photographic silver halide material with a photographic fixing composition that has a pH of from about 4 to about 12 when in aqueous form and comprises:

at least 0.05 mol/l of a thiosulfate fixing agent, at least 0.01 mol/l of sulfite ions, and at least 0.025 mol/l of a phthalic acid or a salt thereof.

11. The method of claim 10 further comprising bleaching said color developed color photographic silver halide material.

12. The method of claim 10 wherein said color photographic silver halide material is a color negative photographic film.

13. A method for providing a color photographic image comprising:

A) color developing an imagewise exposed color photographic silver halide material in a predetermined volume of an aqueous color developing composition in a processing chamber, and B) without removing said predetermined volume of said aqueous color developing composition or said color photographic silver halide material from said processing chamber, adding a predetermined volume of a photographic fixing composition to said processing chamber to provide a combined aqueous color development/fixing composition, and fixing said color photographic silver halide material, said photographic fixing composition having a pH of from about 4 to about 12 when in aqueous form and comprising:

at least 0.05 mol/l of a thiosulfate fixing agent, at least 0.01 mol/l of sulfite ions, and at least 0.025 mol/l of a phthalic acid or a salt thereof.

14. The method of claim 13 wherein said predetermined volume of said color developing composition is from about 50 to 2850 ml/$m^2$ of surface area of processed color photographic silver halide material, and said predetermined volume of said fixing composition introduced into the processing chamber is sufficient to provide an additional volume of from about 6 to about 2000 ml/$m^2$ of surface area of processed color photographic silver halide material.

15. The method of claim 13 further comprising:

C) without removing said combined aqueous color development/fixing composition or said color photographic silver halide material from said processing chamber, adding a predetermined volume of a photographic bleaching composition to said processing chamber to provide a combined aqueous color development/fixing/bleaching composition, and bleaching said color photographic silver halide material.

16. The method of claim 15 wherein said predetermined volume of said photographic bleaching composition is sufficient to provide an additional volume of from about 6 to about 2000 ml/m$^2$ of surface area of processed color photographic silver halide material.

17. The method of claim 15 wherein said predetermined volume of said color developing composition is from about 140 to about 1170 ml/m$^2$ of surface area of processed color photographic silver halide material, the predetermined volume of said fixing composition is from about 20 to about 800 ml/m$^2$ of surface area of processed color photographic silver halide material, and said predetermined volume of said photographic bleaching composition is from about 20 to about 800 ml/m$^2$ of surface area of processed color photographic silver halide material.

18. The method of claim 13 wherein said color photographic silver halide material is a color negative photographic film.

19. The method of claim 13 wherein said aqueous fixing composition has a pH of from about 4.5 to about 7 and comprises:

from about 0.1 to about 4 mol/l of ammonium thiosulfate fixing agent, from about 0.03 to about 0.5 mol/l of sulfite ions, and from about 0.025 to about 0.75 mol/l of sodium hydrogen phthalate, potassium hydrogen phthalate, or a mixture thereof.

20. The method of claim 15 wherein steps A, B, and C are individually carried out at a temperature of from about 20 to about 65° C., and step A is carried out for from about 15 to about 360 seconds, step B is carried out for from about 5 to about 300 seconds, and step C is carried out for from about 10 to about 360 seconds.

21. The method of claim 20 wherein steps A, B, and C are individually carried out at a temperature of from about 30 to about 60° C., and step A is carried out for from about 25 to about 195 seconds, step B is carried out for from about 10 to about 120 seconds, and step C is carried out for from about 25 to about 240 seconds.

22. The method of claim 13 further comprising an acid stop step between steps A and B, and said acid stop step is carried out for from about 5 to about 60 seconds.

* * * * *